US007954265B2

(12) United States Patent
Topcuoglu

(10) Patent No.: US 7,954,265 B2
(45) Date of Patent: Jun. 7, 2011

(54) RENEWAL IN ADVERTISING DISPLAYS AND IN POSTER PLACEMENT

(75) Inventor: Ali Topcuoglu, Istanbul (TR)

(73) Assignee: M. T Reklam Ve Pazarlama Sanayi Ticaret Limited Sirketi, Istanbul (TR)

( * ) Notice: Subject to any disclaimer, the term of this patent is extended or adjusted under 35 U.S.C. 154(b) by 35 days.

(21) Appl. No.: 12/094,407

(22) PCT Filed: Apr. 26, 2006

(86) PCT No.: PCT/TR2006/000016

§ 371 (c)(1),
(2), (4) Date: Oct. 25, 2008

(87) PCT Pub. No.: WO2007/061391

PCT Pub. Date: May 31, 2007

(65) Prior Publication Data

US 2009/0217560 A1 Sep. 3, 2009

(30) Foreign Application Priority Data

Nov. 22, 2005 (TR) ..... U 2005 04637

(51) Int. Cl.
*G09F 7/02* (2006.01)

(52) U.S. Cl. ..... 40/611.01; 40/574; 40/606.18; 362/604; 362/125

(58) Field of Classification Search ..... 40/606.01, 40/604, 611.04, 611.1, 611.12, 734, 729, 40/733, 658, 666
See application file for complete search history.

(56) References Cited

U.S. PATENT DOCUMENTS

| | | | | |
|---|---|---|---|---|
| 190,068 | A * | 4/1877 | Odenbaugh | 40/732 |
| 5,815,971 | A * | 10/1998 | Rothe et al. | 40/718 |
| 6,832,445 | B2 * | 12/2004 | Pitzen | 40/594 |
| 7,272,902 | B2 * | 9/2007 | Ericson | 40/606.18 |

* cited by examiner

*Primary Examiner* — Joanne Silbermann
*Assistant Examiner* — Shin Kim
(74) *Attorney, Agent, or Firm* — Matthias Scholl P.C.; Matthias Scholl

(57) ABSTRACT

The present invention relates to an advertising display, which is used in displaying advertising posters in an illuminated manner, said advertising display comprising a protecting body profile (1), a covering profile (2), a white background material (4) where such poster is attached, and a transparent protector (5) positioned on said poster; and furthermore, at least one a hinge profile that retains the transparent protector (5) in order to easily attach/replace such poster, and to prevent said transparent protector (5) from becoming damaged; at least one magnetic profile and at least one magnetic tape that fasten the moving edge of the transparent protector (5) to the body profile (1) after a poster is attached; and a multitude number of clips retaining the poster between the background (4) and transparent protector (5).

12 Claims, 7 Drawing Sheets

RENEWAL IN ADVERTISING DISPLAYS AND IN POSTER PLACEMENT

TECHNICAL FIELD

The present invention relates to advertising displays displaying advertising posters.

The present invention more particularly relates to exhibiting such posters in an illuminated and two-sided manner and additionally, to providing easiness to the user in changing or replacing such exhibited advertising posters.

BACKGROUND OF INVENTION

There have been realized various embodiments of advertising displays in order to displaying the advertising posters. Such displays have been introduced with different formations and purposes. Such displays are generally constituted in certain geometries with a body, and depending on the structure of this body, for example, as being single- or double-sided, or being circular, a transparent protective covering is employed for one side, and under such transparent covering an advertising poster is placed. On such poster fixed on a surface in such main body, said transparent protective covering is fixed. Regarding these products, the most significant drawback is that a single person can hardly replace or change an advertising poster already fixed therein. In such kind of products, the transparent protective material protecting the poster must be entirely removed from the product while a poster is being replaced. Therefore, it is highly possible that this material is scratched or becomes deformed. When the poster is placed on the rear surface, one person must hold the poster, whereas the protector must be held and assembled by another person.

BRIEF DESCRIPTION OF INVENTION

Concerning the afore-mentioned drawbacks of the relevant art, the objective of the present invention is to eliminate such drawbacks by introducing the subject improvements on advertising displays.

Another objective of the present invention is to make it possible that only one person can replace such advertising posters. Thanks to this facility, both the time required for such poster replacing operations and the number of persons involved in this operation are reduced.

A further objective of the present invention is to provide easiness in attaching an advertising poster to the display, and to avoid the downward-slipping of the poster in time. Thanks to this feature, any slipping to occur in time on the poster is avoided.

In order to achieve said objectives, improvements have been carried out on advertising displays, which comprise at least one protective body and at least one covering profile enclosing said body by its edges; at least one white background element whereon a poster is attached in said body, and at least one transparent protector that is positioned on said poster.

In a preferred embodiment of the present invention, at least one hinge profile is realized that is positioned on a channel opened on said body profile and that retains the transparent protector, in order to allow only a single person to replace such poster, in place of two persons, and to prevent the transparent protection from becoming damaged. Thanks to this feature, it becomes possible to replace the poster by a single person only. Thus, the display elements are kept safe from any external factors, since they are not removed from the display anymore.

In another preferred embodiment of the present invention, at least one double-sided adhesive band is realized that is adhesive by its two sides and is fixed on the (contact) surface of said hinge profile contacting the transparent protector, in order to fix the transparent protector to said hinge profile.

Yet in another preferred embodiment of the present invention, at least one magnetic profile is developed that is positioned on the channel opened on said body profile, in order to fix the other opening/closing end of said transparent protector to the body profile after a poster is attached.

Still in another preferred embodiment of the present invention, at least one magnetic tape is formed that has magnetic attraction characteristics and is fixed to the magnetic profile on a point corresponding to the edge of the transparent protector facing the magnetic profile, in order to provide mutual retention between said magnetic profile and transparent protector. Thanks to this feature, the transparent protector is made stationary when the display is closed such that any deformations such as flexing, sagging etc, on the former, are prevented.

In a further preferred embodiment of the present invention, at least one galvanic sheet is formed that is fixed to the edges of said transparent protector and is adhered to said magnetic tape, in order to provide mutual retention between said magnetic profile and transparent protector.

Yet in a further preferred embodiment of the present invention, at least one double-sided adhesive tape is formed that has adhesive properties from both of its sides, in order to fix said magnetic tape to the magnetic profile.

Still in a further preferred embodiment of the present invention, at least one double-sided adhesive tape is formed that has adhesive properties by both of its sides, in order to fix said galvanic sheet to the transparent protector.

In another preferred embodiment of the present invention, a multitude number of clips are comprised that have fastening gaps slightly smaller than the poster's thickness, are fixed on desired positions on said body profile, and compresses or tightens a poster between said white background element and the transparent protector, in order to prevent said poster from slipping down, once it is assembled to the body profile. Thanks to this feature, any displacement of the poster to occur in time is avoided when it is fixed, and other time-consuming applications such as maintenance, control, correction etc. are avoided.

Still in another preferred embodiment of the present invention, at least one clip stopper is formed with a claw form on the surface pinched or compressed by said clips, in order to prevent said poster from slipping down or moving out in time between/from said clips and to provide additional compression force thereto.

Yet in another preferred embodiment of the present invention, at least one clip screw is comprised in order to fix said clips to the body profile.

Still in a further preferred embodiment of the present invention, said covering profile is formed such that to hide the poster fixing and transparent protector fixing elements in the display.

Yet in a further preferred embodiment of the present invention, the interior of the covering profile is formed with notches along the edges where the transparent protector is fixed to the body profile in the display, in order to provide extra retention force to said covering profile.

In a preferred embodiment of the present invention, a multitude number of springs are provided that are positioned in the interior gap where said covering is fixed to the body profile, in order to provide said covering with restricted circular movement and to avoid any uncontrolled swinging thereof.

REFERENCE NUMBERS IN FIGURES

Figure 1A:
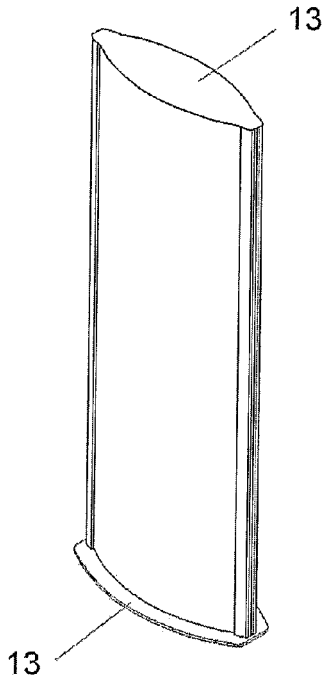
FIG. 1*a* provides a perspective view of the subject advertising display in a representative embodiment of the present invention.
Figure 1B:
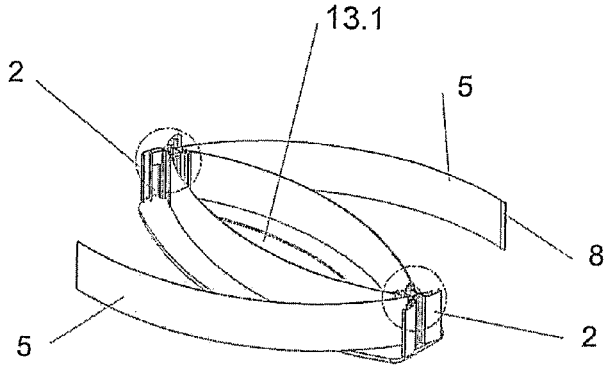
FIG. 1*b* provides a cross-sectional perspective view of the subject advertising display with the coverings in open position, in a representative embodiment of the present invention.
Figure 1C:
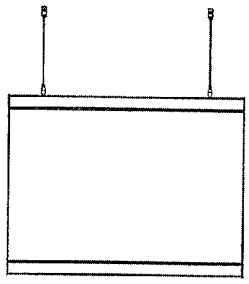
FIG. 1*c* provides a front view of an alternative advertising display in a representative embodiment of the present invention.
Figure 1D:
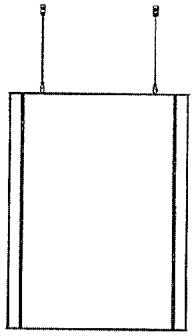
FIG. 1*d* provides a front view of an alternative advertising display in a representative embodiment of the present invention.
Figure 1E:
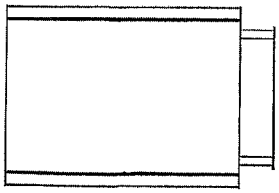
FIG. 1*e* provides a front view of an alternative advertising display in a representative embodiment of the present invention.
Figure 1F:
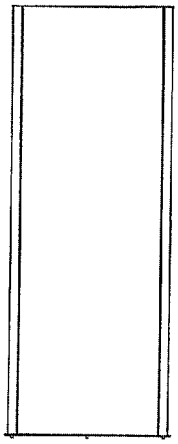
FIG. 1*f* provides a front view of an alternative advertising display in a representative embodiment of the present invention.
Figure 1G:
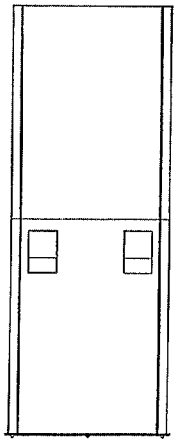
FIG. 1*g* provides a front view of an alternative advertising display in a representative embodiment of the present invention.

1 Body profile
2 Covering profile
3 Covering (steel) spring
4 White background element
5 Transparent protector
6 Clip
6.1 Clip stopper
6.2 Clip screw
7 Double-sided tape
8 Galvanic sheet
9 Hinge profile
10 Magnetic profile
11 Magnetic tape
12 Poster
13 Upper-lower tray
13.1 Light-proofing layer

DETAILED DESCRIPTION OF INVENTION

Figure 2A:
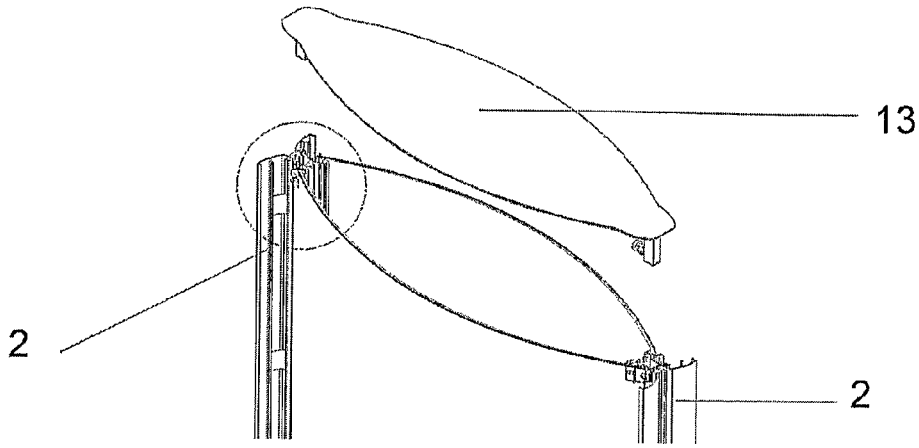
FIG. 2*a* provides a perspective view of the upper tray of the advertising display in a representative embodiment of the present invention.
Figure 2B:
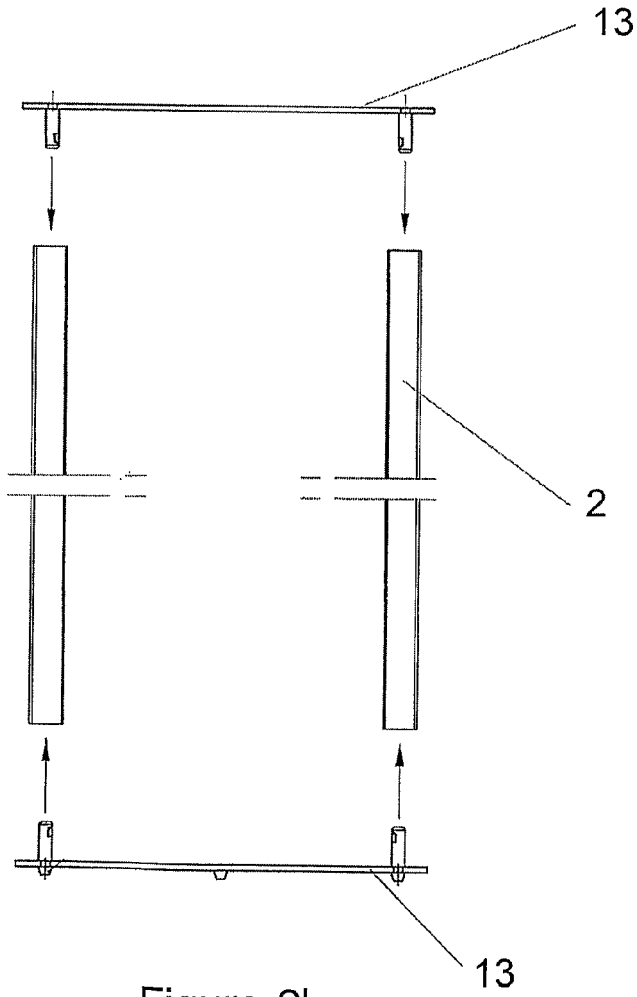
FIG. 2*b* provides a front view of the lower and upper trays, and of the body profiles in a representative embodiment of the present invention.

The embodiments of the present invention as shown in the figures are advertising displays with differing appearances and constructions. The subject advertising display is demountable and has a main construction that is constituted by combining two side body profiles (1) with upper and lower trays (13). The system providing the combining of the body profile (1) with the trays (13) is shown in FIGS. 2*a* and 2*b*. The white background material (4) is attached on the body profile (1), illustrated in FIG. 3*a*, preferably by being engaged to the channel on the covering profile (2). A lightproof layer (13.1) preferably made of polystyrene or hard plastics is adhered to the lower and upper trays in order to prevent light from emitting from the lower and upper joining points of the white background material (4), and to make it more suitable with the lower and upper table forms. The lightproof layer (13.1) both isolates light in the interior and provides light to the illuminating background and mechanical support for the display elements.

Figure 4A:
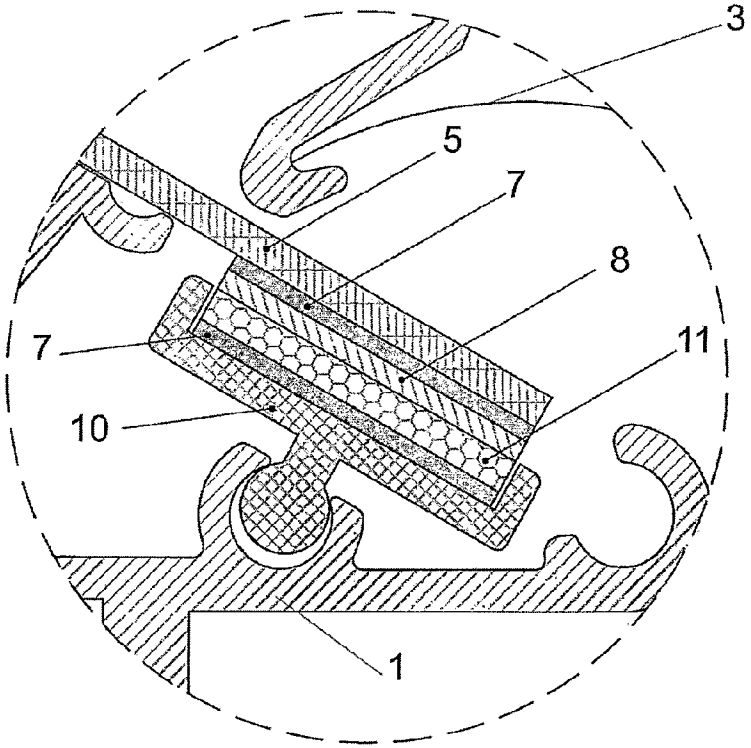
FIG. 4*a* provides a partial cross-sectional top view of the magnetic coupling of the transparent protector of the advertising display, in a representative embodiment of the present invention.
Figure 4B:
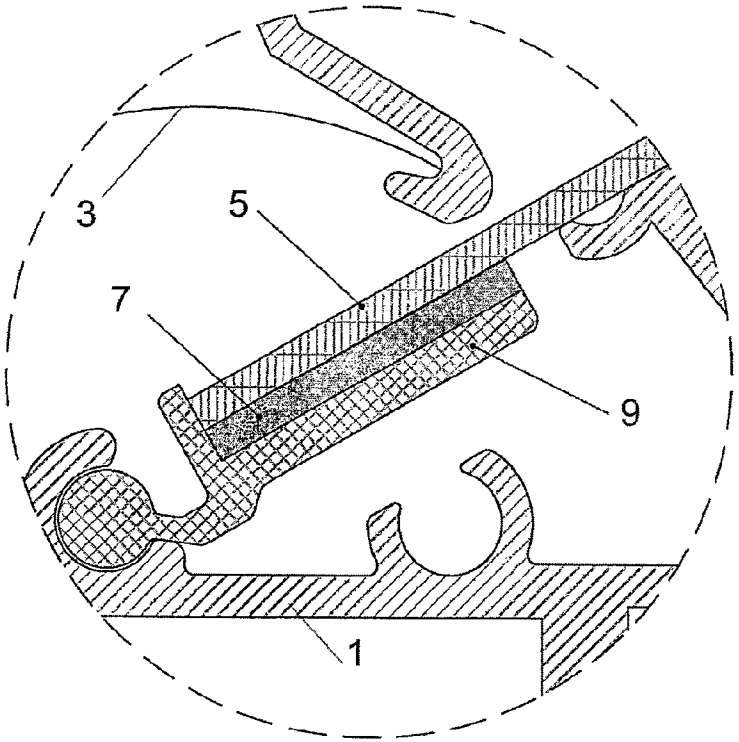
FIG. 4*b* provides a partial cross-sectional top view of the hinge coupling of the transparent protector of the advertising display, in a representative embodiment of the present invention.

Thanks to a hinge profile (9) positioned to a channel opened on the body profile (1), and retaining the transparent protector, as illustrated in FIG. 4*b*, it becomes possible to replace a poster (12) by only one person, in place of two, and any damages on transparent protector (5) are avoided. Thanks to a double-sided adhesive band (7) that is adhesive by both of its sides, and is fixed on the surface of said hinge profile (9) contacting the transparent protector (5), the transparent protector (5) is fixed to said hinge profile (9).

Figure 3A:
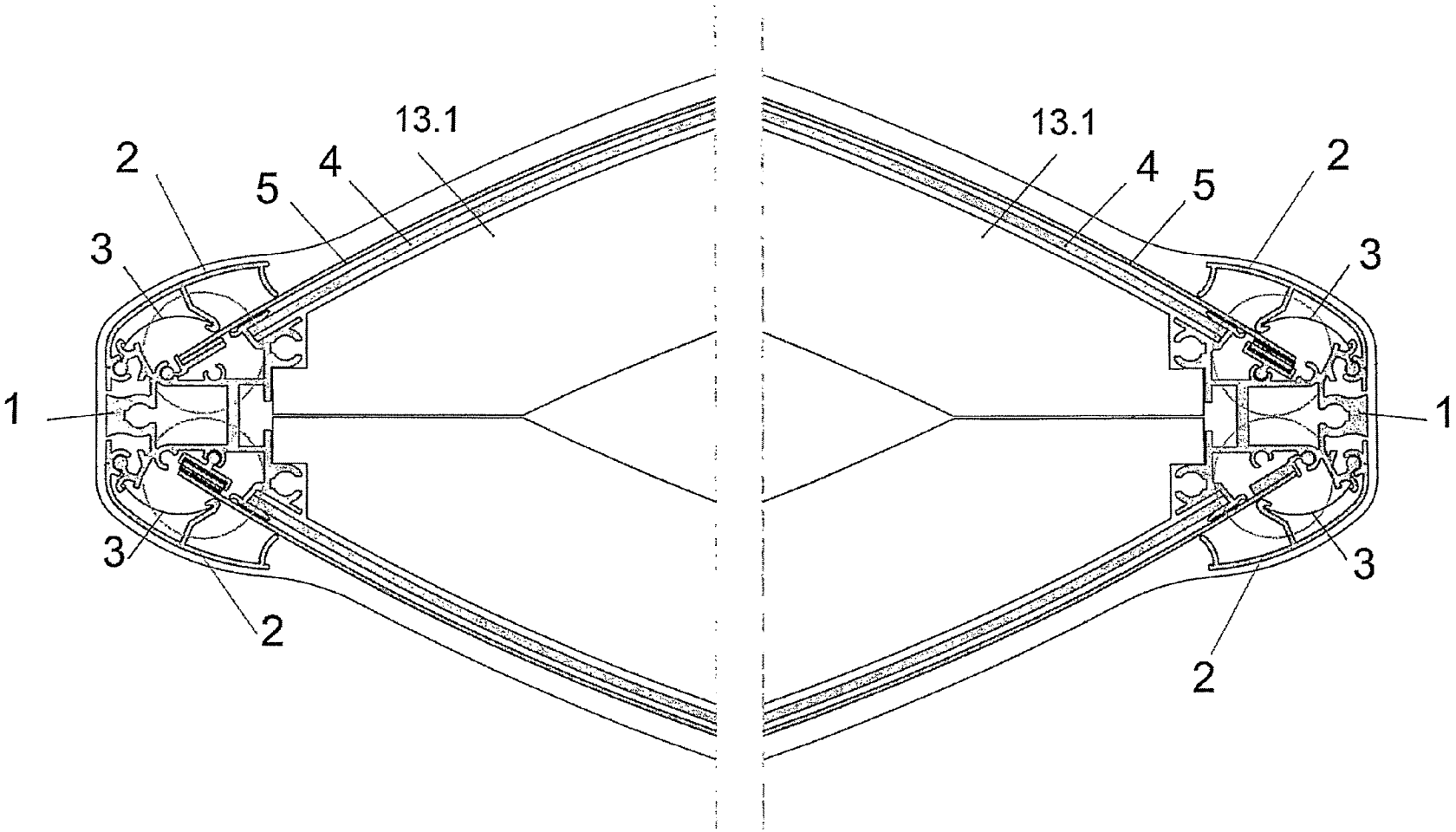
FIG. 3*a* provides a cross-sectional top view of the interior of the advertising display in a representative embodiment of the present invention.
Figure 5A:
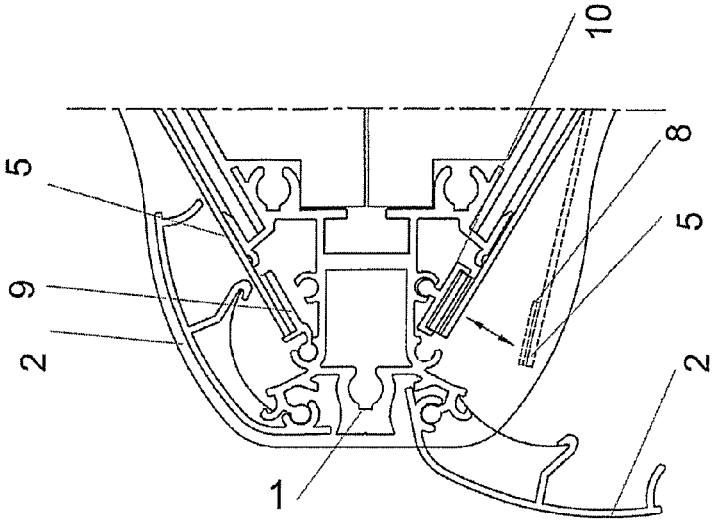
FIG. 5*a* provides a partial cross-sectional top view, where the transparent protector of the subject advertising display operates with the magnetic system, in a representative embodiment of the present invention.
Figure 5B:
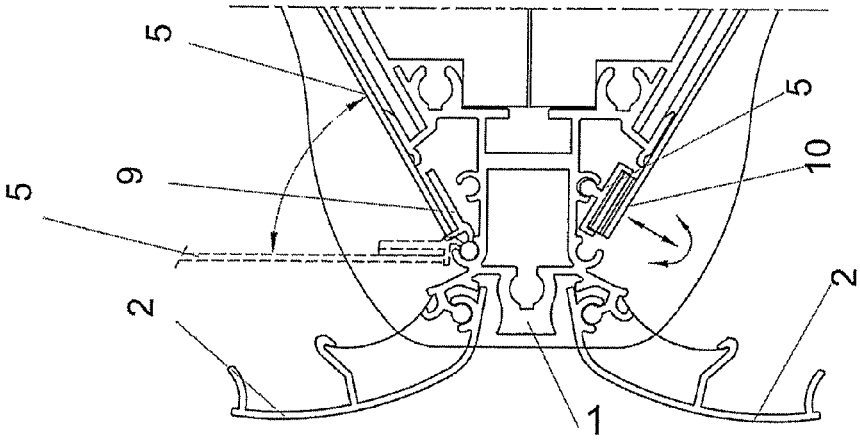
FIG. 5*b* provides a partial cross-sectional top view, where the transparent protector of the subject advertising display operates with the magnetic and hinge systems, in a representative embodiment of the present invention.
Figure 5C:
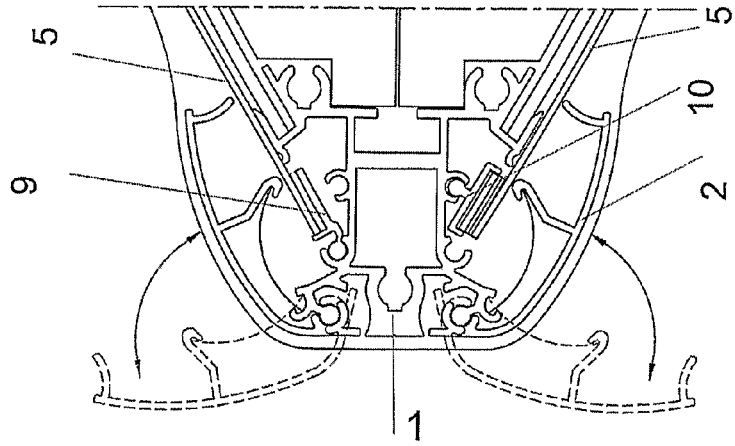
FIG. 5*c* provides a partial cross-sectional top view, where the covering profile of the advertising display is in operative mode, in a representative embodiment of the present invention.
Figure 5D:
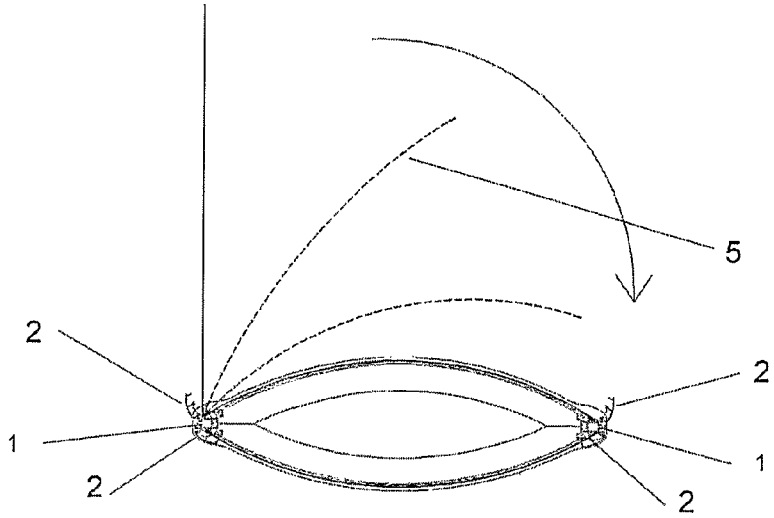
FIG. 5*d* provides a top view of the fastening direction of the transparent protector to the display, in a representative embodiment of the present invention.

Thanks to a magnetic profile (10) positioned to a channel opened on the body profile (1), as illustrated in FIG. 4*a*, the other opening/closing end of the transparent protector is fastened to the body profile (1) after a poster (12) is attached. Thanks to a magnetic tape (11) with magnetic attraction feature that is fixed to the magnetic profile (10) on the edge of the transparent protector (5) facing the latter (10), retention is provided between the magnetic profile (10) and the transparent protector (5). By means of a galvanic sheet (8) that is fixed to the edges of the transparent protector (5), and adhered to the magnetic tape (11), retention is provided between the magnetic profile and the transparent protector (5). The galvanic sheet (8) is preferably in the form of a stripe. By means of a double-sided adhesive tape (7) that is adhesive by both of its sides, the magnetic tape (11) is fixed to the magnetic profile (10). By means of a double-sided adhesive tape (7) that is adhesive by both of its sides, the galvanic sheet (8) is fixed to the transparent protector (5). FIG. 3*a* provides different views of the hinge and magnetic fixing embodiment. FIGS. 5*a*, 5*b*, and 5*c* show respectively the opening and closing stages of the transparent protector (5) and covering profile (2), in a representative embodiment. The transparent protector (5) is fixed to the body profile (1) from one of its edges by means of hinge coupling. This fixation is provided by adhering the hinge profile (9) made preferably from PVC to the protector (5) by means of a double-sided adhesive tape (7). The hinge profile (9) is preferably capable to rotate 60 degrees (position illustrated in FIGS. 5*a*, 5*b*, 5*c*). In FIG. 5*b*, open and closed positions of hinge embodiments, the maximum displacement area of the covering profile (2), and the displacement directions of the transparent protector (5) and magnetic profile (10) are illustrated.

The other edge of the transparent protector (5) is joined with the other-side frame together with magnetic tapes (11). The galvanic sheet (8) is adhered to this edge of the transparent protector (5) preferably by means of a double-sided adhesive tape (7). The galvanic sheet (11) is adhered to this edge of the transparent protector (10) preferably by means of a double-sided adhesive tape (7). The transparent protector (5) and the body profile (1) can be easily combined thanks to said magnetic tape (11). The joining point of the magnetic profile (10) with the body profile (1) is sloped with respect to the positioning of the transparent protector (5). After the poster (12) is properly attached, the transparent protector (5) is closed. After the transparent protector (5) is closed, the covering profiles (2) are closed too such that the display is made ready.

The transparent protector (5) is fixed to the body profile (1) by means of the hinge profile (9). When the covering profiles that stay on their side frames and are assembled to the frames by means of a spring system are opened, the transparent protector material (5) that protects the poster takes an opening position, like a door. One edge of the transparent protector (5) is fixed to the body profile (1) by means of a hinge profile (9), and the other edge is fixed by means of a magnetic tape (11) (see FIG. 3*a*). In order to allow a user to attach a poster (12), the user pulls the protector like a door by means of a holder, which is positioned on the magnetic tape (11) side of the transparent protector and is preferably made to facilitate its opening.

Figure 3B:
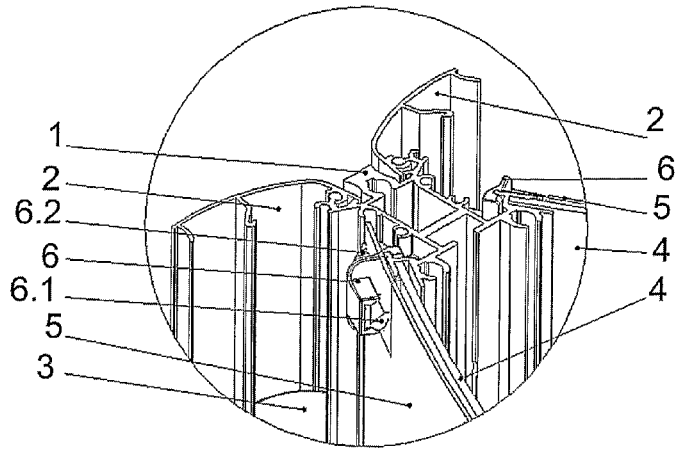
FIG. 3*b* provides a partial cross-sectional perspective view of the clips section of the advertising display, in a representative embodiment of the present invention.
Figure 3C:
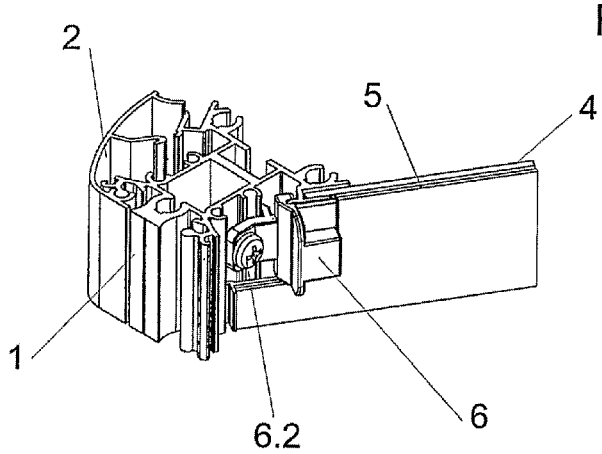
FIG. 3*c* provides a cross-sectional perspective view of the clips section of the advertising display, in a representative embodiment of the present invention.
Figure 3D:
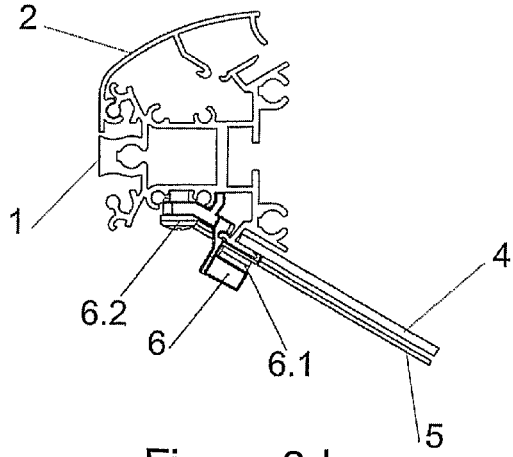
FIG. 3*d* provides a cross-sectional top view of the clips section of the advertising display, in a representative embodiment of the present invention.
Figure 6A:
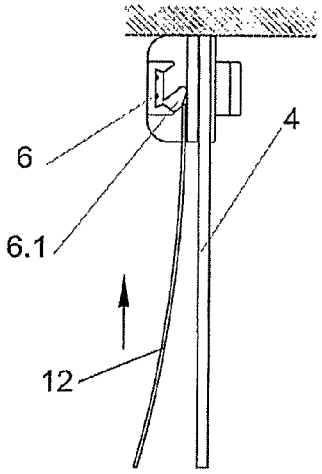
FIG. 6*a* provides a schematic side view, where a poster is attached and fixed to the advertising display clips, in a representative embodiment of the present invention.
Figure 6B:
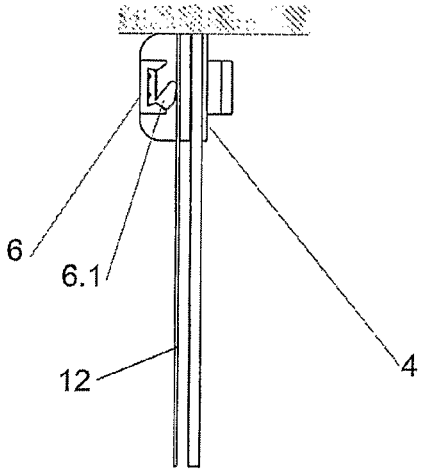
FIG. 6*b* provides a schematic side view, where a poster is attached and fixed to the advertising display clips, in a representative embodiment of the present invention.
Figure 6C:
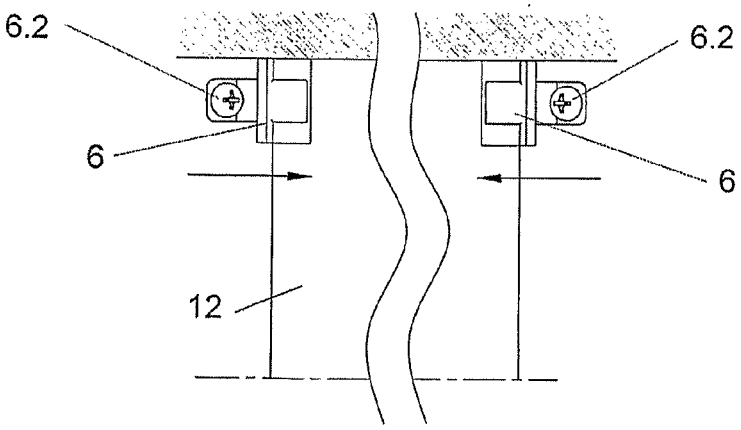
FIG. 6*c* provides a schematic front view, where a poster is attached and fixed to the advertising display clips, in a representative embodiment of the present invention.

As illustrated in FIGS. 3*b*, 3*c*, and 3*d*, a multitude number of clips (6) are provided that have fastening gaps slightly smaller than the thickness of the poster (12), are fixed on desired points on said body profile (1), and compress or tighten a poster between said white background element (4) and the transparent protector (5), in order to attach such poster easily and prevent said poster (12) from slipping, once it is assembled to the body profile (1). Thanks to a multitude number of claw-shaped clip stoppers (6.1) along the surface pinched by such clips (6), the poster is prevented from slipping down from between or moving out of such clips (6) and an thus additional compression force is provided. The clips screw (6.2) fastens the clip (6) to the body profile (1). In order to replace or attach a poster as illustrated in FIGS. 6*a* and 6*b*, the aluminum covering profiles (2) are opened. The poster (12) is fastened to the clips (6) from the upper corners. The stopper (6.1) in the clip (6) prevents the poster (12) from falling down, but it allows it to be removed to sidewise. After the user attaches the poster (12) to the clips, other tasks can be continued by leaving the poster as it is. The clips (6) are fastened by means of clip screws (6.2) on the right and left upper corners on the body profile (1). As illustrated in FIG. 6*c*, the poster is fixed in a down- and upward manner by means of said clips (6), whereas it can be moved only sidewise, i.e. right- and left-ward, only when it is attached or replaced.

In order to easily attach the poster (12) to the display's body profile (1), a multitude number of clips (6) are provided preferably on the upper section of the body profiles (1) so as to retain the poster (12) from its upper corners. The user can attach a poster (12) to these clips (6) in a random manner in the direction as illustrated in the Figure. The clips (6) retain the poster in a single direction, and release it in the opposite direction, systematically. Thanks to these clips (6), the poster (12) can easily be attached to the display so as to provide the user with a convenient opportunity to close the transparent protector (5). The transparent protector (5) that is attached to the body profile (1) by means of a hinge profile (9) can easily be closed like a door on the poster (12). Contacting some points of the galvanic sheet tape (8) provided on the open edge of the transparent protector (5) to the magnetic tape (11) provided on the other side profile of the display is enough to close the transparent protector (5) on the poster (12). A magnetic tape (11) with the same size is provided preferably vertically opposite the galvanic sheet (8).

The covering profile (2) display, as illustrated in FIG. 3*a*, is formed such as to hide the poster (12) fastening (FIGS. 6*a*, 6*b*) and transparent protector (5) fastening elements. The notches provided in the interior of the covering profile (2) provide extra retention by the edges where the transparent protector (5) is fastened to the body profile (1) in the display. Thanks to a multitude number of springs (3) provided in the inner gap where the covering profile (2) is fastened to the body profile (1), the covering profile (2) is provided with a restricted circular motion and any uncontrolled swinging thereof is avoided.

Such advertising displays for standard poster sizes can preferably be manufactured horizontally or vertically with varying designs, as illustrated in FIGS. 1*a*, 1*b*, 1*c*, 1*d*, 1*e*, 1*f*, 1*g*. When the display is used horizontally, it can preferably be fastened to the ceiling by ropes or similar elements, and to the walls by means of metal profile like materials.

The present invention is not to be restricted with the foregoing exemplar embodiments. Based on the essential features under the protection scope as set forth in the claims, any alternative embodiments to be carried out by persons skilled in the art shall be deemed an infringement of the present invention.

The invention claimed is:

1. An advertising display, which comprises at least one protective body profile (1) and at least one covering profile (2) enclosing said body profile (1) by its edges; at least one white background element (4) whereon a poster (12) is attached in said body profile (1), and at least one transparent protector (5) that is positioned on said poster (12), said advertising display being characterized in that, at least one hinge profile (9) is comprised that is positioned on a channel opened on said body profile (1) and that retains the transparent protector (5), in order to allow only a single person to replace such poster (12), in place of two persons, and to prevent said transparent protector (5) from becoming damaged; and at least one double-sided adhesive band (7) is comprised that is adhesive by its two sides, and is fixed on the (contact) surface of said hinge profile (9) contacting the transparent protector (5), in order to fix the transparent protector (5) to said hinge profile (9).

2. An advertising display according to claim 1, characterized in that at least one magnetic profile (10) is comprised that is positioned on the channel opened on said body profile (1).

3. An advertising display according to any of the previous claims, characterized in that at least one magnetic tape (11) is comprised that has magnetic attraction characteristics and is fixed to the magnetic profile (10) on a location that corresponds to the edge of the transparent protector (5) facing the magnetic profile (10).

4. An advertising display according to claim 3, characterized in that at least one galvanic sheet (8) is comprised that is fixed to the edges of said transparent protector (5) and is adhered to said magnetic tape (11).

5. An advertising display according to claim 3, characterized in that at least one double-sided adhesive tape (7) is comprised that has adhesive properties from both of its sides, in order to fix said magnetic tape (11) to the magnetic profile (10).

6. An advertising display according to claim 4, characterized in that at least one double-sided adhesive tape (7) is comprised that has adhesive properties by both of its sides, in order to fix said galvanic sheet (8) to the transparent protector (5).

7. An advertising display, which comprises at least one protective body profile (1) and at least one covering profile (2) enclosing said body profile (1) by its edges; at least one white background element (4) whereon a poster (12) is attached in said body profile (1), and at least one transparent protector (5) that is positioned on said poster (12), said advertising display being characterized in that a multitude number of clips (6) are comprised that have fastening gaps slightly smaller than the thickness of the poster (12), are fixed on desired points on said body profile (1), and compresses or pinches a poster between said white background element (4) and the transparent protector (5), in order to prevent said poster (12) from slipping, once it is assembled to the body profile (1).

8. An advertising display according to claim 7, characterized in that at least one clip stopper (6.1) is comprised with a claw form on the surface pinched by said clips (6).

9. An advertising display according to claim 7 or 8, characterized in that at least one clip screw (6.2) is comprised in order to fix said clips (6) to the body profile (1).

10. An advertising display according to claim 7, characterized in that said covering profile (2) is formed to hide fixing elements for fixing said transparent protector (5) in the display.

11. An advertising display according to claim 7, characterized in that the interior of the covering profile (2) is formed with notches along its edges where the transparent protector (5) is fixed to the body profile (1) in the display, whereby providing extra retention force to said covering profile (2).

12. An advertising display according to claim 7, characterized in that a multitude number of springs (3) are provided that are positioned in an interior gap where said covering (2) is fixed to the body profile (1).

* * * * *